US006511518B1

(12) United States Patent
Houser

(10) Patent No.: US 6,511,518 B1
(45) **Date of Patent: *Jan. 28, 2003**

(54) FUEL ADDITIVE COMPOSITIONS CONTAINING A MANNICH CONDENSATION PRODUCT, A POLY(OXYALKYLENE) MONOOL, A POLYOLEFIN, AND A CARBOXYLIC ACID

(75) Inventor: Keith R. Houser, Pleasant Hill, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 09/675,479

(22) Filed: Sep. 29, 2000

(51) Int. Cl.[7] ..... C10L 1/18; C10L 1/22

(52) U.S. Cl. ..... 44/385; 44/415; 44/443; 44/459

(58) Field of Search ..... 44/415, 443, 459, 44/385

(56) References Cited

U.S. PATENT DOCUMENTS

| | | | | |
|---|---|---|---|---|
| 3,798,247 A | | 3/1974 | Piasek et al. | |
| 4,231,759 A | | 11/1980 | Udelhofen et al. | |
| 4,334,085 A | | 6/1982 | Basalay et al. | 564/367 |
| 4,357,148 A | | 11/1982 | Graiff | |
| 4,877,416 A | | 10/1989 | Campbell | |
| 5,006,130 A | | 4/1991 | Aiello et al. | 44/432 |
| 5,089,028 A | * | 2/1992 | Abramo et al. | 44/347 |
| 5,360,460 A | | 11/1994 | Mozdzen et al. | 44/386 |
| 5,405,419 A | | 4/1995 | Ansari et al. | 44/412 |
| 5,514,190 A | | 5/1996 | Cunningham et al. | 44/415 |
| 5,634,951 A | | 6/1997 | Colucci et al. | 44/415 |
| 5,679,116 A | * | 10/1997 | Cunningham | 44/359 |
| 5,697,988 A | | 12/1997 | Malfer et al. | 44/415 |
| 6,048,373 A | | 4/2000 | Malfer et al. | 44/415 |

* cited by examiner

*Primary Examiner*—Cephia D. Toomer
(74) *Attorney, Agent, or Firm*—Steven G.K. Lee

(57) ABSTRACT

A fuel additive composition comprising:

a) a Mannich condensation product of (1) a high molecular weight alkyl-substituted hydroxyaromatic compound wherein the alkyl group has a number average molecular weight of from about 300 to about 5,000 (2) an amine which contains an amino group having at least one active hydrogen atom, and (3) an aldehyde, wherein the respective molar ratio of reactants (1), (2), and (3) is 1:0.1–10:0.1–10;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a polyolefin polymer of a $C_2$ to $C_6$ mono-olefin, wherein the polymer has a number average molecular weight of about 500 to about 3,000; and d) a carboxylic acid as represented by the formula:

$$R_3(COOH)_f$$

or anhydride thereof, wherein $R_3$ represents a hydrocarbyl group having about 2 to about 50 carbon atoms, and f represents an integer of 1 to about 4.

The unique fuel additive composition of the present invention provides excellent control of engine deposits, particularly engine intake system deposits, such as intake valve deposits.

77 Claims, No Drawings

FUEL ADDITIVE COMPOSITIONS CONTAINING A MANNICH CONDENSATION PRODUCT, A POLY(OXYALKYLENE) MONOOL, A POLYOLEFIN, AND A CARBOXYLIC ACID

BACKGROUND OF THE INVENTION

1. Field of the Invention

The present invention relates to fuel additive compositions containing a Mannich condensation product, a hydrocarbyl-terminated poly(oxyalkylene) monool, a polyolefin polymer, and a carboxylic acid. In a further aspect the present invention relates to the use of these additive compositions in fuel compositions to prevent and control engine deposits, particularly engine intake system deposits, such as intake valve deposits.

2. Description of the Related Art

Numerous deposit-forming substances are inherent in hydrocarbon fuels. These substances, when used in internal combustion engines, tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed by incorporating an active detergent into the fuel. These detergents function to cleanse these deposit-prone areas of the harmful deposits, thereby enhancing engine performance and longevity. There are numerous detergent-type gasoline additives currently available, which, to varying degrees, perform these functions.

Mannich condensation products are known in the art as fuel additives for the prevention and control of engine deposits. For example, U.S. Pat. No. 4,231,759, issued Nov. 4, 1980 to Udelhofen et al., discloses reaction products obtained by the Mannich condensation of a high molecular weight alkyl-substituted hydroxyaromatic compound, an amine containing an amino group having at least one active hydrogen atom, and an aldehyde, such as formaldehyde. This patent further teaches that such Mannich condensation products are useful detergent additives in fuels for the control of deposits on carburetor surfaces and intake valves.

Generally, Mannich condensation products are utilized in combination with other fuel additive components. For example, polyolefins and polyether compounds are also well known in the art as fuel additives. It is not uncommon for the literature to refer to the enhanced benefits of the combination of two or more such fuel additives for the prevention and control of engine deposits.

U.S. Pat. No. 5,514,190, issued May 7, 1996 to Cunningham et al., discloses a fuel additive composition for the control of intake valve deposits which comprises (a) the Mannich reaction product of a high molecular weight alkyl-substituted phenol, an amine, and an aldehyde, (b) a poly (oxyalkylene) carbamate, and (c) a poly(oxyalkylene) alcohol, glycol or polyol, or a mono or diether thereof.

U.S. Pat. No. 5,634,951, issued Jun. 3, 1997 to Colucci et al., discloses gasoline compositions containing Mannich condensation products as detergents. This patent teaches that carrier fluids, including liquid polyalkylenes, may be added to the compositions to enhance the effectiveness of the Mannich condensation products in minimizing or reducing intake valve deposits and/or intake valve sticking.

U.S. Pat. No. 5,697,988, issued Dec. 16, 1997 to Malfer et al., discloses a fuel additive composition which provides reduced fuel injector, intake valve and combustion chamber deposits which comprises (a) the Mannich reaction product of a high molecular weight alkyl-substituted phenol, an amine, and an aldehyde, (b) a polyoxyalkylene compound, preferably a polyoxyalkylene glycol or monoether derivative thereof, and (c) optionally a poly-alpha-olefin.

U.S. Pat. No. 6,048,373, issued Apr. 11, 2000 to Malfer et al., discloses a fuel composition comprising (a) a spark-ignition internal combustion fuel, (b) a Mannich detergent; and (c) a polybutene having a molecular weight distribution (Mw/Mn) of 1.4 or below.

U.S. Pat. No. 4,357,148, issued Nov. 2, 1982 to Graiff, discloses the control or reversal of octane requirement increase together with improved fuel economy in a spark ignition internal combustion engine is achieved by introducing with the combustion charge a fuel composition containing an octane requirement increase-inhibiting amount of certain oil-soluble aliphatic polyamines and certain low molecular weight polymers and/or copolymers of monoolefins having up to 6 carbon atoms, in a certain ratio.

U.S. Pat. No. 4,877,416, issued Oct. 31, 1989 to Campbell, discloses a fuel composition which contains (a) from about 0.001 to 1.0 percent by weight of a hydrocarbyl-substituted amine or polyamine having an average molecular weight of about 750 to 10,000 and at least one basic nitrogen atom, and (b) a hydrocarbyl-terminated poly(oxyalkylene) monool having an average molecular weight of about 500 to 5,000, wherein the weight percent of the hydrocarbyl-terminated poly(oxyalkylene) monool in the fuel composition ranges from about 0.01 to 100 times the amount of hydrocarbyl-substituted amine or polyamine.

U.S. Pat. No. 5,006,130, issued Apr. 9, 1991 to Aiello et al., discloses an unleaded gasoline composition containing a mixture of (a) about 2.5 parts per million by weight or higher of basic nitrogen in the form of an oil-soluble aliphatic alkylene polyamine containing at least one olefinic polymer chain, said polyamine having a molecular weight of about 600 to 10,000, and (b) from about 75 to about 125 parts per million by weight based on the fuel composition of certain oil-soluble olefinic polymers, a poly(oxyalkylene) alcohol, glycol or polyol or a mono or di-ether thereof, non-aromatic naphthenic or paraffinic oils or polyalphaolefins. This patent further teaches that, as a matter of practicality, the basic nitrogen content of the aliphatic polyamine component is usually about 4.0 or below and that this generally corresponds to a concentration of about 100 to 160 ppm when the aliphatic polyamine is a 1,050 molecular weight aliphatic diamine, such as N-polyisobutenyl N'-N'-dimethyl-1, 3-diaminopropane.

U.S. Pat. No. 5,405,419, issued Apr. 11, 1995 to Ansari et al., discloses a fuel additive composition comprising (a) a fuel-soluble aliphatic hydrocarbyl-substituted amine having at least one basic nitrogen atom wherein the hydrocarbyl group has a number average molecular weight of about 700 to 3,000; (b) a polyolefin polymer of a $C_2$ to $C_6$ mono-olefin, wherein the polymer has a number average molecular weight of about 350 to 3,000; and (c) a hydrocarbyl-terminated poly(oxyalkylene) monool having an average molecular weight of about 500 to 5,000. This patent further teaches that fuel compositions containing these additives will generally contain about 50 to 500 ppm by weight of the aliphatic amine, about 50 to 1,000 ppm by weight of the polyolefin and about 50 to 1,000 ppm by weight of the poly(oxyalkylene) monool. This patent also discloses that fuel compositions containing 125 ppm each of aliphatic amine, polyolefin and poly(oxyalkylene) monool provide better deposit control performance than compositions containing 125 ppm of aliphatic amine plus 125 ppm of poly (oxyalkylene) monool.

U.S. Pat. No. 3,798,247, Mar. 19, 1974 issued to Piasek and Karll, discloses that the reaction under Mannich condensation conditions, like other chemical reactions, does not go to theoretical completion and some portion of the reactants, generally the amine, remains unreacted or only partially reacted as a coproduct. Unpurified products of Mannich processes also commonly contain small amounts of insoluble particle byproducts of the Mannich condensation reaction that appear to be the high molecular weight condensation product of formaldehyde and polyamines. The amine and amine byproducts lead to haze formation during storage and, in diesel oil formulations, to rapid buildup of diesel engine piston ring groove carbonaceous deposits and skirt varnish. The insoluble or borderline soluble byproducts are substantially incapable of removal by filtration and severely restrict product filtration rate. These drawbacks were overcome by adding long-chain carboxylic acids during the reaction to reduce the amount of solids formation from the Mannich reaction. This was thought to render the particulate polyamine-formaldehyde condensation product soluble through formation of amide-type links. In particular, oleic acid worked well at 0.1 to 0.3 mole/mole of alkylphenol. The quantity of unconsumed or partially reacted amine was not mentioned in the patent.

U.S. Pat. No. 4,334,085, issued Jun. 6, 1982 to Basalay and Udelhofen, discloses that Mannich condensation products can undergo transamination, and use this to solve the problem of byproduct amine-formaldehyde resin formation encountered in U.S. Pat. No. 3,748,247 eliminating the need for using a fatty acid. U.S. Pat. No. 4,334,085 defined transamination as the reaction of a Mannich adduct based on a single-nitrogen amine with a polyamine to exchange the polyamine for the single-nitrogen amine. The examples in this patent infer that the unconsumed amine and partially reacted amine discussed in U.S. Pat. No. 3,798,247 are not merely unconsumed, but must be in chemical equilibrium with the product of the Mannich condensation reaction. In Example 1 of U.S. Pat. No. 4,334,085, a Mannich condensation product is made from 0.5 moles of polyisobutylphenol, 1.0 mole of diethylamine and 1.1 moles of formaldehyde. To 0.05 moles of this product was added 0.05 moles of tetraethylenepentamine (TEPA) and then the mixture was heated to 155° C. while blowing with nitrogen. The TEPA replaced 80 to 95% of the diethylamine in the Mannich as the nitrogen stripped off the diethylamine made available by the equilibrium with the Mannich.

U.S. Pat. No. 5,360,460, issued Nov. 1, 1994 to Mozdzen et al., discloses a fuel additive composition comprising (A) an alkylene oxide condensate or the reaction product thereof and an alcohol, (B) a monocarboxylic fatty acid, and (C) a hydrocarbyl amine, or the reaction product thereof and an alkylene oxide. The fuel additive composition deals with cleaning of injection ports, lubricating a fuel line system in a diesel vehicle, and with minimizing corrosion in the fuel line system. However, the use of a Mannich condensation product is neither disclosed nor suggested.

SUMMARY OF THE INVENTION

It has now been discovered that a certain combination of a Mannich condensation product, a hydrocarbyl-terminated poly(oxyalkylene) monool, a polyolefin polymer, and a carboxylic acid affords a unique fuel additive composition which provides excellent control of engine deposits, particularly engine intake system deposits, such as intake valve deposits.

Accordingly, the present invention provides a novel fuel additive composition comprising:

a) a Mannich condensation product of (1) a high molecular weight alkyl-substituted hydroxyaromatic compound wherein the alkyl group has a number average molecular weight of from about 300 to about 5,000 (2) an amine which contains an amino group having at least one active hydrogen atom, and (3) an aldehyde, wherein the respective molar ratio of reactants (1), (2), and (3) is 1:0.1–10:0.1–10;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a polyolefin polymer of a $C_2$ to $C_6$ mono-olefin, wherein the polymer has a number average molecular weight of about 500 to about 3,000; and d) a carboxylic acid as represented by the formula:

$$R_3(COOH)_f$$

or anhydride thereof, wherein $R_3$ represents a hydrocarbyl group having about 2 to about 50 carbon atoms, and f represents an integer of 1 to about 4.

The present invention further provides a fuel composition comprising a major amount of hydrocarbons boiling in the gasoline or diesel range and an effective deposit controlling amount of a fuel additive composition of the present invention.

The present invention additionally provides a fuel concentrate comprising an inert stable oleophilic organic solvent boiling in the range of from about 150° F. to about 400° F. and from about 10 to about 90 weight percent of a fuel additive composition of the present invention.

The present invention provides further still for a method of controlling engine deposits in an internal combustion engine by operating an internal combustion engine with a fuel composition containing the fuel additive composition of the present invention.

Among other factors, the present invention is based on the surprising discovery that the unique combination of a Mannich condensation product, a hydrocarbyl-terminated poly (oxyalkylene) monool, a polyolefin polymer, and a carboxylic acid provides excellent control of engine deposits, particularly engine intake system deposits, such as intake valve deposits.

DETAILED DESCRIPTION OF THE INVENTION

The fuel additive composition of the present invention comprises a Mannich condensation product, a hydrocarbyl-terminated poly(oxyalkylene) monool, a polyolefin polymer, and a carboxylic acid.

Definitions

Prior to discussing the present invention in detail, the following terms will have the following meanings unless expressly stated to the contrary.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "alkylene" refers to straight- and branched-chain alkylene groups having at least 2 carbon atoms. Typical alkylene groups include, for example, ethylene ($—CH_2CH_2—$), propylene ($—CH_2CH_2CH_2—$), isopropylene ($—CH(CH_3)CH_2—$), n-butylene ($—CH_2CH_2CH_2CH_2—$), sec-butylene ($—CH(CH_2CH_3)CH_2—$), n-pentylene ($—CH_2CH_2CH_2CH_2CH_2—$), and the like.

The term "polyoxyalkylene" refers to a polymer or oligomer having the general formula:

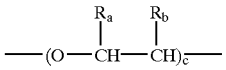

wherein $R_a$ and $R_b$ are each independently hydrogen or lower alkyl groups, and c is an integer from about 5 to about 100. When referring herein to the number of oxyalkylene units in a particular polyoxyalkylene compound, it is to be understood that this number refers to the average number of oxyalkylene units in such compounds unless expressly stated to the contrary.

The term "fuel" or "hydrocarbon fuel" refers to normally liquid hydrocarbons having boiling points in the range of gasoline and diesel fuels.

The Mannich Condensation Product

Mannich reaction products employed in this invention are obtained by condensing an alkyl-substituted hydroxyaromatic compound whose alkyl-substituent has a number average molecular weight of from about 300 to about 5,000, preferably polyalkylphenol whose polyalkyl substituent is derived from 1-mono-olefin polymers having a number average molecular weight of from about 300 to about 5,000, more preferably from about 400 to about 3,000; an amine containing at least one >NH group, preferably an alkylene polyamine of the formula:

$$H_2N—(A—NH—)_dH$$

wherein A is a divalent alkylene radical having 1 to about 10 carbon atoms and d is an integer from 1 to about 10; and an aldehyde, preferably formaldehyde, in the presence of a solvent.

High molecular weight Mannich reaction products useful as additives in the fuel additive compositions of this invention are preferably prepared according to conventional methods employed for the preparation of Mannich condensation products, using the above-named reactants in the respective molar ratios of high molecular weight alkyl-substituted hydroxyaromatic compound, amine, and aldehyde of approximately 1.0:0.1–10:1–10. A suitable condensation procedure involves adding at a temperature of from about room temperature to 95° C., the formaldehyde reagent (e.g., formalin) to a mixture of amine and alkyl-substituted hydroxyaromatic compounds alone or in an easily removed organic solvent, such as benzene, xylene, or toluene or in solvent-refined neutral oil, and then heating the reaction mixture at an elevated temperature (about 120° to about 175° C.) while the water of reaction is distilled overhead and separated. The reaction product so obtained is finished by filtration and dilution with solvent as desired.

Preferred Mannich reaction product additives employed in this invention are derived from high molecular weight Mannich condensation products, formed by reacting an alkylphenol, an ethylene polyamine, and a formaldehyde affording reactants in the respective molar ratio of 1.0.0.5–2.0:1.0–3.0, wherein the alkyl group of the alkylphenol has a number average weight of from about 300 to about 5,000.

Representatives of the high molecular weight alkyl-substituted hydroxyaromatic compounds are polypropylphenol, polybutylphenol, and other polyalkylphenols, with polyisobutylphenol being the most preferred. Polyalkylphenols may be obtained by the alkylation, in the presence of an alkylating catalyst such as $BF_3$, of phenol with high molecular weight polypropylene, polybutylene, and other polyalkylene compounds to give alkyl substituents on the benzene ring of phenol having a number average molecular weight of from about 300 to about 5,000.

The alkyl substituents on the hydroxyaromatic compounds may be derived from high molecular weight polypropylenes, polybutenes, and other polymers of mono-olefins, principally 1-mono-olefins. Also useful are copolymers of mono-olefins with monomers copolymerizable therewith, wherein the copolymer molecule contains at least about 90% by weight of mono-olefin units. Specific examples are copolymers of butenes (1-butene, 2-butene, and isobutylene) with monomers copolymerizable therewith wherein the copolymer molecule contains at least about 90% by weight of propylene and butene units, respectively. Said monomers copolymerizable with propylene or said butenes include monomers containing a small proportion of unreactive polar groups, such as chloro, bromo, keto, ether, or aldehyde, which do not appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene, and the like. From the foregoing limitation placed on the monomer copolymerized with propylene or said butenes, it is clear that said polymers and copolymers of propylene and said butenes are substantially aliphatic hydrocarbon polymers. Thus, the resulting alkylated phenols contain substantially alkyl hydrocarbon substitutents having a number average molecular weight of from about 300 to about 5,000.

In addition to the foregoing high molecular weight hydroxyaromatic compounds, other phenolic compounds which may be used include, high molecular weight alkyl-substituted derivatives of resorcinol, hydroquinone, cresol, cathechol, xylenol, hydroxy-di-phenyl, benzylphenol, phenethylphenol, naphthol, tolylnaphthol, among others. Preferred for the preparation of such preferred Mannich condensation products are the polyalkylphenol reactants, e.g., polypropylphenol and polybutylphenol, particularly polyisobutylphenol, whose alkyl group has a number average molecular weight of about 300 to about 5,000, preferably about 400 to about 3,000, more preferably about 500 to about 2,000, and most preferably about 700 to about 1,500.

As noted above, the polyalkyl substituent on the polyalkyl hydroxyaromatic compounds employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene, and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl hydroxyaromatic compounds are polyisobutenes which comprise at least about 20% of the more reactive methylvinylidene isomer, preferably at least about 50% and more preferably at least about 70% methylvinylidene isomer. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 10, a polyisobutene having a molecular weight of about 950 and a methylvinylidine content of about 76%, and Ultravis 30, a polyisobutene having a molecular weight of about 1,300 and a methylvinylidene content of about 74%, both available from British Petroleum, and Glissopal 1000, 1300, and 2200, available from BASF.

The preferred configuration of the alkyl-substituted hydroxyaromatic compound is that of a para-substituted mono-alkylphenol. However, any alkylphenol readily reactive in the Mannich condensation reaction may be employed.

Accordingly, ortho monoalkylphenols and dialkylphenols are suitable for use in this invention.

Representative amine reactants are alkylene polyamines, principally polyethylene polyamines. Other representative organic compounds containing at least one >NH group suitable for use in the preparation of the Mannich reaction products are well known and include the mono- and di-amino alkanes and their substituted analogs, e.g., ethylamine, dimethylamine, dimethylaminopropyl amine, and diethanol amine; aromatic diamines, e.g., phenylene diamine, diamino naphthalenes; heterocyclic amines, e.g., morpholine, pyrrole, pyrrolidine, imidazole, imidazolinidine, and piperidine; melamine and their substituted analogs.

The alkylene polyamine reactants, which are useful with this invention, include polyamines that are linear, branched, or cyclic; or a mixture of linear, branched and/or cyclic polyamines wherein each alkylene group contains from 1 to about 10 carbon atoms. A preferred polyamine is a polyamine containing from about 2 to about 10 nitrogen atoms per molecule or a mixture of polyamines containing an average of from about 2 to about 10 nitrogen atoms per molecule such as ethylenediamine, diethylene triamine, triethylene tetramine, tetraethylene pentamine, pentaethylene hexamine, hexaethylene heptamine, heptaethylene octamine, octaethylene nonamine, nonaethylene decamine, and mixtures of such amines. Corresponding propylene polyamines such as propylene diamine, dipropylene triamine, tripropylene tetramine, tetrapropylene pentamine, and pentapropylene hexamine are also suitable reactants. A particularly preferred polyamine is a polyamine or mixture of polyamines having from about 3 to about 7 nitrogen atoms, with diethylene triamine or a combination or mixture of ethylene polyamines whose physical and chemical properties approximate that of diethylene triamine being the most preferred. In selecting an appropriate polyamine, consideration should be given to the compatibility of the resulting detergent/dispersant with the gasoline fuel mixture with which it is mixed.

Ordinarily the most highly preferred polyamine, diethylene triamine, will comprise a commercially available mixture having the general overall physical and/or chemical composition approximating that of diethylene triamine but which can contain minor amounts of branched-chain and cyclic species as well as some linear polyethylene polyamines such as triethylene tetramine and tetraethylene pentamine. For best results, such mixtures should contain at least about 50% and preferably at least about 70% by weight of the linear polyethylene polyamines enriched in diethylene triamine.

The alkylene polyamines are usually obtained by the reaction of ammonia and dihalo alkanes, such as dichloro alkanes. Thus, the alkylene polyamines are obtained from the reaction of about 2 to about 11 moles of ammonia with 1 to about 10 moles of dichloro alkanes having about 2 to about 6 carbon atoms and the chlorines on different carbons.

Representative aldehydes for use in the preparation of the high molecular weight Mannich reaction products employed in this invention include the aliphatic aldehydes such as formaldehyde, acetaldehyde, propionaldehyde, butyraldehyde, valeraldehyde, caproaldehyde, heptaldehyde, and stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The Hydrocarbyl-Terminated Poly(oxyalkylene) Monool

The hydrocarbyl-terminated poly(oxyalkylene) polymers employed in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as ethylene oxide, propylene oxide, the butylene oxides, or the pentylene oxides to the hydroxy compound $R_1OH$ under polymerization conditions, wherein $R_1$ is the hydrocarbyl group which caps the poly(oxyalkylene) chain. Methods of production and properties of these polymers are disclosed in U.S. Pat. Nos. 2,841,479 and 2,782,240 and Kirk-Othmer's "Encyclopedia of Chemical Technology", 2nd Ed Volume 19, p. 507. In the polymerization reaction, a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular eight.

The polyethers employed in this invention can be represented by the formula:

$$R_1O—(R_2O)_e—H$$

wherein $R_1$ is a hydrocarbyl group of from 1 to about 30 carbon atoms; $R_2$ is a $C_2$ to $C_5$ alkylene group; and e is an integer such that the molecular weight of the polyether is from about 500 to about 5,000.

Preferably, $R_1$ is a $C_7$ to $C_{30}$ alkylphenyl group. Most preferably, $R_1$ is dodecylphenyl.

Preferably, $R_2$ is a $C_3$ or $C_4$ alkylene group. Most preferably, $R_2$ is a $C_3$ alkylene group.

Preferably, the polyether has a molecular weight of from about 750 to about 3,000; and more preferably from about 900 to about 1,500.

The Polyolefin Polymer

The polyolefin polymer component of the present fuel additive composition is a polyolefin polymer of a $C_2$ to $C_6$ mono-olefin, wherein the polyolefin polymer has a number average molecular weight of about 500 to about 3,000. The polyolefin polymer may be a homopolymer or a copolymer. Block copolymers are also suitable for use in this invention.

In general, the polyolefin polymer will have a number average molecular weight of about 500 to about 3,000, preferably about 700 to about 2,500, and more preferably from about 750 to about 1,800. Particularly preferred polyolefin polymers will have a number average molecular weight of about 750 to about 1,500.

The polyolefin polymers employed in the present invention are generally polyolefins that are polymers or copolymers of mono-olefins, particularly 1-mono-olefins, such as ethylene, propylene, butylene, and the like. Preferably, the mono-olefin employed will have about 2 to about 4 carbon atoms, and more preferably, about 3 to about 4 carbon atoms. More preferred mono-olefins include propylene and butylene, particularly isobutylene. Polyolefins prepared from such mono-olefins include polypropylene and polybutene, especially polyisobutene.

The polyisobutenes which are suitable for use in the present invention include conventional polyisobutenes, as well as high alkylvinylidene polyisobutenes which comprise at least about 20% of the more reactive methylvinylidene isomer, preferably at least about 50% and more preferably at least about 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 30, a polyisobutene having a number average molecular weight of about 1,300 and a methylvinylidene content of about 74%, and Ultravis 10, a 950 molecular weight polyisobutene having a methylvinylidene content of about 76%, both available from British Petroleum, and Glissopal 1000, 1300, and 2200, available from BASF.

Conventional polyisobutenes include those having a number average molecular weight of about 700 to about 2,500, such as Parapol 950, a polyisobutene having a number average molecular weight of about 950, available from Exxon-Mobil Chemical Company.

The Carboxylic Acid

The fuel additive composition of the present invention further contains a carboxylic acid compound. The carboxylic acid to be employed in the invention preferably is a compound that is represented by the formula:

$$R_3(COOH)_f$$

or anhydride thereof, wherein $R_3$ represents a hydrocarbyl group having about 2 to about 50 carbon atoms, and f represents an integer of 1 to about 4.

The preferred hydrocarbyl groups are aliphatic groups, such as alkyl group and an alkenyl group, which may have a straight chain or a branched chain. Examples of preferred carboxylic acids are aliphatic acids having about 8 to about 30 carbon atoms and include capric acid, lauric acid, myristic acid, stearic acid, isostearic acid, arachic acid, behenic acid, lignoceric acid, cerotic acid, montanic acid, melissic acid, caproleic acid, oleic acid, eraidic acid, linolic acid, linoleic acid, fatty acid or coconut oil, fatty acid of hardened fish oil, fatty acid of hardened rapeseed oil, fatty acid of hardened tallow oil, and fatty acid of hardened palm oil. The examples further include dodecenyl succinic acid and its anhydride. Preferably, the carboxylic acid is oleic acid.

Fuel Compositions

The fuel additive composition of the present invention will generally be employed in hydrocarbon fuels to prevent and control engine deposits, particularly intake valve deposits. Typically, the desired control of engine deposits will be achieved by operating an internal combustion engine with a fuel composition containing the additive composition of the present invention. The proper concentration of additive necessary to achieve the desired control of engine deposits varies depending upon the type of fuel employed, the type of engine, engine oil, operating conditions, and the presence of other fuel additives.

Generally, the present fuel additive composition will be employed in a hydrocarbon fuel in a concentration ranging from about 31 to about 4,000 parts per million (ppm) by weight, preferably from about 51 to about 2,500 ppm.

In terms of individual components, hydrocarbon fuel containing the fuel additive composition of this invention will generally contain about 20 to about 1,000 ppm, preferably about 30 to about 400 ppm, of the Mannich condensation product component, about 5 to about 2,000 ppm, preferably about 10 to about 400 ppm, of the hydrocarbyl-terminated poly(oxyalkylene) monool component, about 5 to about 2,000 ppm, preferably about 10 to about 400 ppm of the polyolefin polymer, and 1 to about 100 ppm, preferably 1 to about 20 ppm of the carboxylic acid. The weight ratio of the Mannich condensation product to the hydrocarbyl-terminated poly(oxyalkylene) monool to the polyolefin polymer to the carboxylic acid will generally range from about 100:25:25:1 to about 100:200:200:10 and will preferably be about 100:25:25:1 to about 100:150:150:5.

The fuel additive composition of the present invention may be formulated as a concentrate using an inert stable oleophilic (i.e., dissolves in gasoline) organic solvent boiling in the range of about 150° F. to about 400° F. (about 65° C. to about 205° C.). Preferably, an aliphatic or an aromatic hydrocarbon solvent is used, such as benzene, toluene, xylene, or higher-boiling aromatics or aromatic thinners. Aliphatic alcohols containing about 3 to about 8 carbon atoms, such as isopropanol, isobutylcarbinol, n-butanol, and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent.

In gasoline fuels, other fuel additives may be employed with the additive composition of the present invention, including, for example, oxygenates, such as t-butyl methyl ether, antiknock agents, such as methylcyclopentadienyl manganese tricarbonyl, and other dispersants/detergents, such as hydrocarbyl amines, or succinimides. Additionally, antioxidants, corrosion inhibitors, metal deactivators, demulsifiers, other inhibitors and carburetor or fuel injector detergents may be present.

In diesel fuels, other well-known additives can be employed, such as pour point depressants, flow improvers, lubricity improvers, cetane improvers, and the like.

The gasoline and diesel fuels employed with the fuel additive composition of the present invention also include clean burning gasoline where levels of sulfur, aromatics, and olefins range from typical amounts to only trace amounts and clean burning diesel fuel where levels of sulfur and aromatics range from typical amounts to only trace amounts.

A fuel-soluble, nonvolatile carrier fluid or oil may also be used with the fuel additive composition of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis, and polyesters, such as those described, for example, in U.S. Pat. No. 3,756,793 to Robinson and U.S. Pat. No. 5,004,478 to Vogel et al., and in European Patent Application Nos. 356,726, published Mar. 7, 1990, and 382,159, published Aug. 16, 1990.

These carrier fluids are believed to act as a carrier for the fuel additive composition of the present invention and to assist in the control of engine deposits, particularly engine intake system deposits, such as the intake valves. The carrier fluid may also exhibit synergistic engine deposit control properties when used in combination with the fuel additive composition of this invention.

The carrier fluids are typically employed in amounts ranging from about 25 to about 5,000 ppm by weight of the hydrocarbon fuel, preferably from about 100 to about 3,000 ppm of the fuel. Preferably, the ratio of carrier fluid to fuel additive will range from about 0.2:1 to about 10:1, more preferably from about 0.5:1 to about 3:1.

When employed in a fuel concentrate, carrier fluids will generally be present in amounts ranging from about 20 to about 60 weight percent, preferably from about 30 to about 50 weight percent.

EXAMPLES

The invention will be further illustrated by the following examples, which set forth particularly advantageous specific embodiments of the present invention. While the examples are provided to illustrate the present invention, it is not intended to limit it.

In the following examples and tables, the components of the fuel additive composition are defined as follows:

A. The term "Mannich" refers to a Mannich condensation product made from the reaction of polyisobutylphenol, formaldehyde, and diethylenetriamine in a ratio of 1.2:1, prepared in the manner as described in Example 1. The polyisobutylphenol was produced from polyisobutylene containing at least 70% methylvinylidene isomer as described in U.S. Pat. No. 5,300,701.

B. The Oleic Acid was available as TI 05 from Cognis Edenor Corporation, as well as from J. T. Baker Company and other suppliers.

C. The term "POPA" refers to a dodecylphenyl-terminated poly(oxypropylene) monool having an average molecular weight of about 1,000.

D. The term "1000 MW PIB" refers to a 1,000 molecular weight polyisobutylene containing at least 70% material with methylvinylidene end groups, such as Glissopal 1000 from BASF.

E. The term "950 MW PIB" refers to a 950 molecular weight conventional polyisobutylene, such as Parapol 950 from Exxon-Mobil Chemical Company.

Example 1

Mannich Condensation Product

A Mannich condensation product was produced in a reactor equipped with a distillation column and an overhead Dean-Stark trap system by the following general procedure. A solution of polyisobutylphenol in Solvesso Aromatic 100 solvent was charged to the reactor at about 40° to about 45.6° C. Solvesso Aromatic 100 solvent is manufactured by Exxon Chemical Company. The polyisobutylphenol was produced from polyisobutylene containing at least about 70% methylvinylidene isomer as described in U.S. Pat. No. 5,300,701, and is incorporated herein for all purposes. The polyisobutylphenol had a nonvolatile residue of about 67.5% and a hydroxyl number of about 40.0 mg KOH/g. Diethylenetriamine (DETA) having an assay of about 99.2% was charged to the reactor in the ratio one mole of DETA per mole of polyisobutylphenol and thoroughly mixed with the polyisobutylphenol. Heating of the reactor was started after charging of the DETA. When the reactor temperature was about 55° to about 60° C., paraformaldehyde, having a purity of about 91.9%, was charged to the reactor. The charge ratio was two moles of formaldehyde per mole of polyisobutylphenol. The temperature was increased over three hours to about 175° to about 177° C. and the pressure gradually lowered to about 520 to about 540 mm Hg. As byproduct water formed, water and solvent vapor distilled from the reactor and passed up through the distillation column. The byproduct water and solvent were separated and the solvent returned to the column as reflux so that no net solvent was taken overhead. The final temperature and pressure were held for about 6 hours to make sure the Mannich condensation reaction went to completion. The Mannich condensation product was cooled to about 60° C. and pumped to storage without the need for filtering.

The Mannich condensation product was clear (1% haze using Nippon Denshoku Model 300A haze meter), light gold in color (2.5 by ASTM D1500), and contained about 2.7% nitrogen. A 3-gram sample of the Mannich condensation product was diluted with 100 mL of hexane and 0.1 mL of demulsifier and then extracted twice with 40 mL of warm water. The water extract was titrated with 0.1 N hydrochloric acid. The water-soluble amine content was measured as about 0.176 mEg/g.

In another analytical method, 2 g of the Mannich condensation product was diluted with 0.5 g of n-butanol and 1 g of deionized water in a vial and thoroughly mixed. After phase separation, the aqueous layer was recoved and analyzed by gas chromatography ("GC"). Reference standards and mass spectroscopy were used to identify the major peaks. Based on this analysis, the Mannich condensation product contained 0.61% DETA and 0.16% of 1-(2-aminoethyl), 3-isodiazolidine (DETA with one formaldehyde-derived methylene group bridging two adjacent nitrogens). There were other DETA-formaldehyde compounds present, but the major constituent was 1-(2-aminoethyl), 3-isodiazolidine. The GC method does not account for all of the water-soluble amine measured by the titration method because not all GC peaks are quantified and because of differences in the extraction procedures.

TABLE I

Ford 2.3 L Engine Dynamometer Test Cycle

| | Cycle Step Duration (Seconds) | Engine Speed (RPM) | Engine Manifold Absolute Pressure (Millimeters of Mercury) |
|---|---|---|---|
| | 270 | 2000 | 230 |
| | 510 | 2800 | 539 |
| Total | 780 | | |

The test results from the Ford 2.3L Engine Dynamometer Test are set forth in Table II and III.

TABLE II

Ford 2.3 L Engine Dynamometer Test Results (Stand 7B)

| Sample | Mannich (ppma) | Oleic Acid (ppm) | POPA (ppm) | 1000 MW PIB | Ratio POPA + PIB: Mannich | AVG IVD (mg./vlv.) |
|---|---|---|---|---|---|---|
| Base | 0 | 0 | 0 | 0 | | 567 |
| 1 | 60 | 0 | 60 | 0 | 1 | 328 |
| 2 | 60 | 0 | 30 | 30 | 1 | 239 |
| 3 | 60 | 2.7 | 60 | 0 | 1 | 335 |
| 4 | 60 | 2.7 | 30 | 30 | 1 | 176 |

TABLE III

Ford 2.3 L Engine Dynamometer Test Results (Stand 1B)

| Sample | Mannich (ppma) | Oleic Acid (ppm) | POPA (ppm) | 1000 MW PIB (ppm) | 950 MW PIB (ppm) | Ratio POPA + PIB: Mannich | AVG IVD (mg./vlv.) |
|---|---|---|---|---|---|---|---|
| Base | 0 | 0 | 0 | 0 | | | 849 |
| 1 | 60 | 0 | 60 | 0 | | 1 | 376 |
| 2 | 60 | 0 | 30 | 30 | | 1 | 320 |
| 3 | 60 | 2.7 | 60 | 0 | | 1 | 356 |
| 4 | 60 | 2.7 | 30 | 30 | | 1 | 298 |
| 5 | 80 | 3.6 | 20 | 20 | | 0.5 | 418 |
| 6 | 80 | 3.6 | 20 | | 20 | 0.5 | 325 |

As can be seen in Table II and III the replacement of a portion of POPA with PIB and the addition of oleic acid in Sample 4 provides an unexpected reduction in IVD mass relative to comparative Samples 1, 2, and 3. In Table III, Sample 6 and Sample 5 show that the replacement of a high alkylvinylidene content 1000 MW PIB with a conventional 950 MW PIB provides reduced IVD mass.

Example 2

Ford 2.3L Engine Dynamometer Testing

The fuel additive composition of the present invention was tested in two different four-cylinder Ford 2.3L engine dynamometer test stands to evaluate intake valve and combustion chamber deposit control performance. The four-cylinder Ford 2.3L engine is port fuel injected and has twin spark plugs. The engine is prepared for tests in accordance with accepted engine testing practices. The engine test is 60 hours in length and consists of 277 repetitions of a 13-minute cycle.

The details of the test cycle for the Ford 2.3L engine are set forth in Table I.

Example 3

GM 3.1L Engine Dynamometer Testing

The fuel additive composition of the present invention was tested in a six-cylinder GM 3.1L engine dynamometer test stand to evaluate intake valve and combustion chamber deposit control performance. The six-cylinder GM 3.1L engine is port fuel injected. The engine is prepared for tests in accordance with accepted engine testing practices. The engine test is 120 hours in length and consists of 360 repetitions of a 20-minute cycle.

The details of the test cycle for the GM 3.1L engine are set forth in Table IV.

TABLE IV

GM 3.1 L Engine Dynamometer Test Cycle

| | Cycle Step Duration (Seconds) | Engine Speed (RPM) | Engine Manifold Absolute Pressure (Millimeters of Mercury) |
|---|---|---|---|
| | 60 | 800 | No Spec |
| | 180 | 1500 | 314 |
| | 300 | 2450 | 352 |
| | 180 | 1800 | 377 |
| | 360 | 2800 | 405 |
| | 120 | 1500 | 314 |
| Total: | 720 | | |

The test results from the GM 3.1L Engine Dynamometer Test are set forth in Table V.

TABLE V

GM 3.1 L Engine Dynamometer Test Results (Stand 1A)

| Sample | Mannich (ppma) | Oleic Acid (ppm) | POPA (ppm) | 1000 MW PIB (ppm) | Ratio POPA + PIB: Mannich | AVG IVD (mg./vlv.) |
|---|---|---|---|---|---|---|
| Base | 0 | 0 | 0 | 0 | | 362 |
| 1 | 60 | 0 | 60 | 0 | 1 | 316 |
| 2 | 60 | 0 | 30 | 30 | 1 | 286 |
| 3 | 60 | 2.7 | 30 | 30 | 1 | 230 |

As can be seen in Sample 3 in Table V the replacement of a portion of POPA with PIB and the addition of oleic acid provides an unexpected improvement in Avg. IVD relative to comparative Samples 1 and 2.

Example 4

GM 2.4L Engine Dynamometer Testing

The fuel additive composition of the present invention was tested in a four-cylinder GM 2.4L engine dynamometer test stand to evaluate intake valve and combustion chamber deposit control performance. The four-cylinder GM 2.4L engine is port fuel injected and is of a four valve per cylinder configuration. The engine is prepared for tests in accordance with accepted engine testing practices. The engine test is approximately 124 hours in length and consists of 74 repetitions of a 100-minute cycle.

The details of the test cycle for the GM 2.4L engine are set forth in Table VI.

TABLE VI

GM 2.4 L Engine Dynamometer Test Cycle

| | Cycle Step Duration (Seconds) | Engine Speed (RPM) | Engine Manifold Absolute Pressure (Millimeters of Mercury) |
|---|---|---|---|
| | 15 | 800 | No Spec |
| | 705 | 2000 | 365 |
| | 1005 | 2400 | 398 |
| | 690 | 2000 | 365 |
| | 1485 | 2400 | 398 |
| | 1095 | 1500 | 353 |
| | 1005 | 2400 | 398 |
| Total: | 6000 | | |

The test results from the GM 2.4L Engine Dynamometer Test are set forth in Table VII.

TABLE VII

GM 2.4 L Engine Dynamometer Test Results (Stand 1A)

| Sample | Mannich (ppma) | Oleic Acid (ppm) | POPA (ppm) | 1000 MW PIB: (ppm) | Ratio POPA + PIB: Mannich | AVG IVD (mg./vlv.) |
|---|---|---|---|---|---|---|
| Base | 0 | 0 | 0 | 0 | | 299 |
| 1 | 40 | 0 | 40 | 0 | 1 | 157 |
| 2 | 40 | 1.8 | 40 | 0 | 1 | 176 |
| 3 | 40 | 0 | 20 | 20 | 1 | 238 |
| 4 | 40 | 1.8 | 20 | 20 | 1 | 153 |

As can be seen in Sample 4 in Table VII, the replacement of a portion of POPA with PIB and the addition of oleic acid provides an unexpected improvement in Avg. IVD relative to comparative Samples 1, 2, and 3.

Example 5

Daimler-Benz M102E 2.3L Engine Dynamometer Testing

The fuel additive composition of the present invention was tested in two different four-cylinder Daimler Benz 2.3L engine dynamometer test stands to evaluate intake valve and combustion chamber deposit control performance. The four cylinder Daimler Benz 2.3L engine has KE-Jetronic fuel metering. The engine is prepared for tests in accordance with accepted engine testing practices. The engine test is 60 hours in length and consists of 800 repetitions of a 270-second cycle.

The details of the test cycle for the M102E engine are set forth in Table VIII.

TABLE VIII

Daimler-Benz M102E 2.3 L Engine Dynamometer Test Cycle

| | Cycle Step Duration (Seconds) | Engine Speed (RPM) | Engine Torque (Nm) |
|---|---|---|---|
| | 30 | 800 | 0.0 |
| | 60 | 1300 | 29.4 |
| | 120 | 1850 | 32.5 |
| | 60 | 3000 | 35.0 |
| Total: | 270 | | |

The test results from the Daimler-Benz M102E Engine Dynamometer Test are set forth in Tables IX and X.

TABLE IX

Daimler-Benz M102E Engine Dynamometer Test Results (Cell 17)

| Sample | Mannich (ppma) | Oleic Acid (ppm) | POPA (ppm) | 1000 MW PIB (ppm) | 950 MW PIB (ppm) | Ratio POPA + PIB: Mannich | AVG IVD (mg./vlv.) |
|---|---|---|---|---|---|---|---|
| Base | 0 | 0 | 0 | 0 | 0 | | 107 |
| 1 | 125 | 0 | 125 | 0 | 0 | 1 | 105 |
| 2 | 125 | 5.5 | 125 | 0 | 0 | 1 | 78 |
| 3 | 125 | 0 | 62.5 | 62.5 | 0 | 1 | 72 |
| 4 | 125 | 5.5 | 62.5 | 62.5 | 0 | 1 | 50 |
| 5 | 125 | 5.5 | 62.5 | 0 | 62.5 | 1 | 47 |

TABLE X

Daimler-Benz M102E Engine Dynamometer Test Results (Cell 3)

| Sample | Man-nich (ppma) | Oleic Acid (ppm) | POPA (ppm) | 1000 MW PIB: (ppm) | Ratio POPA + PIB: Mannich | AVG IVD (mg./vlv.) |
|---|---|---|---|---|---|---|
| Base | 0 | 0 | 0 | 0 | | 173 |
| 1 | 125 | 0 | 125 | 0 | 1 | 57 |
| 2 | 125 | 5.5 | 125 | 0 | 1 | 42 |
| 3 | 125 | 0 | 62.5 | 62.5 | 1 | 27 |
| 4 | 125 | 5.5 | 62.5 | 62.5 | 1 | 56 |

As can be seen in Table IX, the replacement of a portion of POPA with PIB and the addition of oleic acid in Sample 4 provides an unexpected reduction in IVD mass relative to comparative Samples 1, 2, and 3. Furthermore, in Table IX, Sample 5 and Sample 4 show that the replacement of a high alkylvinylidene content 1000 MW PIB with a conventional 950 MW PIB provides equivalent IVD performance. Table X shows the replacement of a portion of POPA with PIB and the addition of oleic acid in Sample 4 provides performance at least as good as comparative Sample 1.

Example 6

Daimler-Benz M111 2.0L Engine Dynamometer Testing

The fuel additive composition of the present invention was tested in a four-cylinder Daimler-Benz 2.0L engine dynamometer test stand to evaluate intake valve and combustion chamber deposit control performance. The four-cylinder Daimler-Benz 2.0L engine has electronic multi-point fuel metering. The engine is prepared for tests in accordance with accepted engine testing practices. The engine test is 60 hours in length and consists of 800 repetitions of a 270-second cycle.

The details of the test cycle for the M102E engine are set forth in Table XI.

TABLE XI

Daimler-Benz M111 2.0 L Engine Dynamometer Test Cycle

| | Cycle Step Duration (Seconds) | Engine Speed (RPM) | Engine Torque (Nm) |
|---|---|---|---|
| | 30 | 800 | 0 |
| | 60 | 1500 | 40 |
| | 120 | 2500 | 40 |
| | 60 | 3800 | 40 |
| Total: | 270 | | |

The test results from the Daimler-Benz M111 Engine Dynamometer Test are set forth in Table XII.

TABLE XII

Daimler-Benz M111 Engine Dynamometer Test Results (Cell 17)

| Sample | Mannich (ppma) | Oleic Acid (ppm) | POPA (ppm) | 1000 MW PIB (ppm) | 950 MW PIB (ppm) | Ratio POPA + PIB: Mannich | AVG IVD (mg./vlv.) |
|---|---|---|---|---|---|---|---|
| Base | 0 | 0 | 0 | 0 | 0 | | 154 |
| 1 | 90 | 0 | 90 | 0 | 0 | 1 | 56 |
| 2 | 90 | 4.0 | 90 | 0 | 0 | 1 | 25 |
| 3 | 90 | 0 | 45 | 45 | 0 | 1 | 25 |
| 4 | 90 | 4.0 | 45 | 45 | 0 | 1 | 25 |
| 5 | 90 | 4.0 | 45 | 0 | 45 | 1 | 23 |

As can be seen in Table XII the replacement of a portion of POPA with PIB and the addition of oleic acid in Sample 4 provides equal or better IVD mass control relative to comparative Samples 1, 2, and 3. Furthermore, in Table XII, Sample 4 and Sample 5 show that the replacement of a high alkylvinylidene content 1000 MW PIB with a conventional 950 MW PIB provides equivalent IVD performance.

While the present invention has been described with reference to specific embodiments, this application is intended to cover those changes and substitutions that may be made by those skilled in the art without departing from the spirit and scope of the appended claims.

What is claimed is:

1. A fuel additive composition comprising:

a) a Mannich condensation product of (1) a high molecular weight alkyl-substituted hydroxyaromatic compound wherein the alkyl group has a number average molecular weight of from 300 to about 5,000 (2) an amine which contains an amino group having at least one active hydrogen atom, and (3) an aldehyde, wherein the respective molar ratio of reactants (1), (2), and (3) is 1:0.1–10:0.1–10;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a polyolefin polymer of a $C_2$ to $C_6$ mono-olefin, wherein the polymer has a number average molecular weight of about 500 to about 3,000; and d) a monocarboxylic acid having about 8 to about 30 carbon atom.

2. The fuel additive composition according to claim 1, wherein the alkyl group on said alkyl-substituted hydroxyaromatic compound has a number average molecular weight of about 400 to about 3,000.

3. The fuel additive composition according to claim 2, wherein the alkyl group on said alkyl-substituted hydroxyaromatic compound has a number average molecular weight of about 500 to about 2,000.

4. The fuel additive composition according to claim 3, wherein the alkyl group on said alkyl-substituted hydroxyaromatic compound has a number average molecular weight of about 700 to about 1,500.

5. The fuel additive composition according to claim 1, wherein the alkyl-substituted hydroxyaromatic compound is a polyalkylphenol.

6. The fuel additive composition according to claim 5, wherein the polyalkylphenol is polypropylphenol or polyisobutylphenol.

7. The fuel additive composition according to claim 6, wherein the polyalkylphenol is polyisobutylphenol.

8. The fuel additive composition according to claim 7, wherein the polyisobutylphenol is derived from polyisobutene containing at least about 70% methylvinylidine isomer.

9. The fuel additive composition according to claim 1, wherein the amine component of said Mannich condensation product is an alkylene polyamine having the formula:

$$H_2N—(A—NH)_d—H$$

wherein A is a divalent alkylene radical having 1 to about 10 carbon atoms and d is an integer from 1 to about 10.

10. The fuel additive composition according to claim 9, wherein the alkylene polyamine is polyethylene polyamine.

11. The fuel additive composition according to claim 10, wherein the polyethylene polyamine is diethylene triamine.

12. The fuel composition according to claim 1, wherein the respective molar ratio of reactants (1), (2), and (3) is 1.0:0.5–2.0:1.0–3.0.

13. The fuel additive composition according to claim 1, wherein the aldehyde component of said Mannich condensation product is formaldehyde, paraformaldehyde or formalin.

14. The fuel additive composition according to claim 1, wherein the hydrocarbyl-terminated poly(oxyalkylene) monool has an average molecular weight of about 900 to about 1,500.

15. The fuel additive composition according to claim 1, wherein the oxyalkylene group of the hydrocarbyl-terminated polyoxyalkylene group of said hydrocarbyl-terminated poly(oxyalkylene) monool is a $C_3$ to $C_4$ oxyalkylene group.

16. The fuel additive composition according to claim 15, wherein the oxyalkylene group of said hydrocarbyl-terminated poly(oxyalkylene) monool is a $C_3$ oxypropylene group.

17. The fuel additive composition according to claim 15, wherein the oxyalkylene group of said hydrocarbyl-terminated poly(oxyalkylene) monool is a $C_4$ oxybutylene group.

18. The fuel additive composition according to claim 1, wherein the hydrocarbyl group of said hydrocarbyl-terminated poly(oxyalkylene) monool is a $C_7$ to $C_{30}$ alkylphenyl group.

19. The fuel additive composition according to claim 1, wherein the polyolefin polymer is a polymer of a $C_2$ to $C_4$ mono-olefin.

20. The fuel additive composition according to claim 19, wherein the polyolefin polymer is polypropylene or polybutene.

21. The fuel additive composition according to claim 20, wherein the polyolefin polymer is polyisobutene.

22. The fuel additive composition according to claim 21, wherein the polyisobutene comprises at least about 70% methylvinylidene isomer.

23. The fuel additive composition according to claim 1, wherein the polyolefin polymer has a number average molecular weight of about 700 to about 2,500.

24. The fuel additive composition according to claim 23, wherein the polyolefin polymer has a number average molecular weight of about 750 to about 1,800.

25. The fuel additive composition according to claim 1, wherein the hydrocarbyl-terminated poly(oxyalkylene) monool is a $C_7$ to $C_{30}$ alkylphenyl-terminated poly (oxypropylene) monool and said polyolefin polymer is polyisobutene.

26. The fuel additive composition according to claim 1, wherein the monocarboxylic acid is oleic acid.

27. A fuel composition comprising a major amount of hydrocarbon fuel boiling in the gasoline or diesel range and an effective deposit controlling amount of a fuel additive composition comprising:

a) a Mannich condensation product of (1) a high molecular weight alkyl-substituted hydroxyaromatic compound wherein the alkyl group has a number average molecular weight of from 300 to about 5,000 (2) an amine which contains an amino group having at least one active hydrogen atom, and (3) an aldehyde, wherein the respective molar ratio of reactants (1), (2), and (3) is 1:0.1–10:0.1–10;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a polyolefin polymer of a $C_2$ to $C_6$ mono-olefin, wherein the polymer has a number average molecular weight of about 500 to about 3,000; and d) a monocarboxylic acid having about 8 to about 30 carbon atoms.

28. The fuel composition according to claim 27, wherein the alkyl group on said alkyl-substituted hydroxyaromatic compound has a number average molecular weight of about 400 to about 3,000.

29. The fuel composition according to claim 28, wherein the alkyl group on said alkyl-substituted hydroxyaromatic compound has a number average molecular weight of about 500 to about 2,000.

30. The fuel composition according to claim 29, wherein the alkyl group on said alkyl-substituted hydroxyaromatic compound has a number average molecular weight of about 700 to about 1,500.

31. The fuel composition according to claim 27, wherein the alkyl-substituted hydroxyaromatic compound is a polyalkylphenol.

32. The fuel composition according to claim 31, wherein the polyalkylphenol is polypropylphenol or polyisobutylphenol.

33. The fuel composition according to claim 32, wherein the polyalkylphenol is polyisobutylphenol.

34. The fuel composition according to claim 33, wherein the polyisobutylphenol is derived from polyisobutene containing at least about 70% methylvinylidine isomer.

35. The fuel composition according to claim 27, wherein the amine component of said Mannich condensation product is an alkylene polyamine having the formula:

$$H_2N—(A—NH)_d—H$$

wherein A is a divalent alkylene radical having 1 to about 10 carbon atoms and d is an integer from 1 to about 10.

36. The fuel composition according to claim 35, wherein the alkylene polyamine is polyethylene polyamine.

37. The fuel composition according to claim 36, wherein the polyethylene polyamine is diethylene triamine.

38. The fuel composition according to claim 27, wherein the aldehyde component of said Mannich condensation product is formaldehyde, paraformaldehyde or formalin.

39. The fuel composition according to claim 27, wherein the hydrocarbyl-terminated poly(oxyalkylene) monool has an average molecular weight of about 900 to about 1,500.

40. The fuel composition according to claim 27, wherein the oxyalkylene group of the hydrocarbyl-terminated poly-oxyalkylene group of said hydrocarbyl-terminated poly (oxyalkylene) monool is a $C_3$ to $C_4$ oxyalkylene group.

41. The fuel composition according to claim 40, wherein the oxyalkylene group of said hydrocarbyl-terminated poly (oxyalkylene) monool is a $C_3$ oxypropylene group.

42. The fuel composition according to claim 40, wherein the oxyalkylene group of said hydrocarbyl-terminated poly (oxyalkylene) monool is a $C_4$ oxybutylene group.

43. The fuel composition according to claim 27, wherein the hydrocarbyl group of said hydrocarbyl-terminated poly (oxyalkylene) monool is a $C_7$ to $C_{30}$ alkylphenyl group.

44. The fuel composition according to claim 27, wherein the polyolefin polymer is a polymer of a $C_2$ to $C_4$ mono-olefin.

45. The fuel composition according to claim 44, wherein the polyolefin polymer is polypropylene or polybutene.

46. The fuel composition according to claim 45, wherein the polyolefin polymer is polyisobutene.

47. The fuel composition according to claim 46, wherein the polyisobutene comprises at least about 70% methylvinylidene isomer.

48. The fuel composition according to claim 27, wherein the polyolefin polymer has a number average molecular weight of about 700 to about 2,500.

49. The fuel composition according to claim 48, wherein the polyolefin polymer has a number average molecular weight of about 750 to about 1,800.

50. The fuel composition according to claim 27, wherein the hydrocarbyl-terminated poly(oxyalkylene) monool is a $C_7$ to $C_{30}$ alkylphenyl-terminated poly(oxypropylene) monool and said polyolefin polymer is polyisobutene.

51. The fuel composition according to claim 28, wherein the monocarboxylic acid is oleic acid.

52. A fuel concentrate comprising an inert stable oleophilic organic solvent boiling in the range of from about 150° F. to about 400° F. and from about 10 to about 90 weight percent of an additive composition comprising:

a) a Mannich condensation product of (1) a high molecular weight alkyl-substituted hydroxyaromatic compound wherein the alkyl group has a number average molecular weight of from 300 to about 5,000 (2) an amine which contains an amino group having at least one active hydrogen atom, and (3) an aldehyde, wherein the respective molar ratio of reactants (1), (2), and (3) is 1:0.1–10:0.1–10;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a polyolefin polymer of a $C_2$ to $C_6$ mono-olefin, wherein the polymer has a number average molecular weight of about 500 to about 3,000; and d) a monocarboxylic acid having about 8 to about 30 carbon atoms.

53. The fuel concentrate according to claim 52, wherein the alkyl group on said alkyl-substituted hydroxyaromatic compound has a number average molecular weight of about 400 to about 3,000.

54. The fuel concentrate according to claim 53, wherein the alkyl group on said alkyl-substituted hydroxyaromatic compound has a number average molecular weight of about 500 to about 2,000.

55. The fuel concentrate according to claim 54, wherein the alkyl group on said alkyl-substituted hydroxyaromatic compound has a number average molecular weight of about 700 to about 1,500.

56. The fuel concentrate according to claim 52, wherein the alkyl-substituted hydroxyaromatic compound is a polyalkylphenol.

57. The fuel concentrate according to claim 56, wherein the polyalkylphenol is polypropylphenol or polyisobutylphenol.

58. The fuel concentrate according to claim 57, wherein the polyalkylphenol is polyisobutylphenol.

59. The fuel concentrate according to claim 58, wherein the polyisobutylphenol is derived from polyisobutene containing at least about 70% methylvinylidine isomer.

60. The fuel concentrate according to claim 52, wherein the amine component of said Mannich condensation product is an alkylene polyamine having the formula:

$$H_2N—(A—NH)_d—H$$

wherein A is a divalent alkylene radical having 1 to about 10 carbon atoms and d is an integer from 1 to about 10.

61. The fuel concentrate according to claim 60, wherein the alkylene polyamine is polyethylene polyamine.

62. The fuel concentrate according to claim 61, wherein the polyethylene polyamine is diethylene triamine.

63. The fuel concentrate according to claim 52, wherein the aldehyde component of said Mannich condensation product is formaldehyde, paraformaldehyde or formalin.

64. The fuel concentrate according to claim 52, wherein the hydrocarbyl-terminated poly(oxyalkylene) monool has an average molecular weight of about 900 to about 1,500.

65. The fuel concentrate according to claim 52, wherein the oxyalkylene group of the hydrocarbyl-terminated poly-oxyalkylene group of said hydrocarbyl-terminated poly (oxyalkylene) monool is a $C_3$ to $C_4$ oxyalkylene group.

66. The fuel concentrate according to claim 65, wherein the oxyalkylene group of said hydrocarbyl-terminated poly (oxyalkylene) monool is a $C_3$ oxypropylene group.

67. The fuel concentrate according to claim 65, wherein the oxyalkylene group of said hydrocarbyl-terminated poly (oxyalkylene) monool is a $C_4$ oxybutylene group.

68. The fuel concentrate according to claim 52, wherein the hydrocarbyl group of said hydrocarbyl-terminated poly (oxyalkylene) monool is a $C_7$ to $C_{30}$ alkylphenyl group.

69. The fuel concentrate according to claim 52, wherein the polyolefin polymer is a polymer of a $C_2$ to $C_4$ monoolefin.

70. The fuel concentrate according to claim 69, wherein the polyolefin polymer is polypropylene or polybutene.

71. The fuel concentrate according to claim 70, wherein the polyolefin polymer is polyisobutene.

72. The fuel concentrate according to claim 71, wherein the polyisobutene comprises at least about 70% methylvinylidene isomer.

73. The fuel concentrate according to claim 52, wherein the polyolefin polymer has a number average molecular weight of about 700 to about 2,500.

74. The fuel concentrate according to claim 73, wherein the polyolefin polymer has a number average molecular weight of about 750 to about 1,800.

75. The fuel concentrate according to claim 52, wherein the hydrocarbyl-terminated poly(oxyalkylene) monool is a $C_7$ to $C_{30}$ alkylphenyl-terminated poly(oxypropylene) monool and said polyolefin polymer is polyisobutene.

76. The fuel concentrate according to claim 54, wherein the monocarboxylic acid is oleic acid.

77. A method of controlling engine deposits in an internal combustion engine, said method comprising operating an internal combustion engine with a fuel composition containing the fuel additive composition of claim 1.

* * * * *